US010851589B2

(12) United States Patent
von Gynz-Rekowski et al.

(10) Patent No.: US 10,851,589 B2
(45) Date of Patent: Dec. 1, 2020

(54) INTEGRATED BEARING SECTION AND METHOD

(71) Applicant: Rival Downhole Tools LC, Houston, TX (US)

(72) Inventors: Gunther H H von Gynz-Rekowski, Montgomery, TX (US); Mark Allen Reeves, The Woodlands, TX (US); William Christian Herben, Magnolia, TX (US)

(73) Assignee: Rival Downhole Tools LC, Houston, TX (US)

( * ) Notice: Subject to any disclaimer, the term of this patent is extended or adjusted under 35 U.S.C. 154(b) by 231 days.

(21) Appl. No.: 15/965,330

(22) Filed: Apr. 27, 2018

(65) Prior Publication Data

US 2019/0330922 A1 Oct. 31, 2019

(51) Int. Cl.
*E21B 4/00* (2006.01)

(52) U.S. Cl.
CPC ..... *E21B 4/003* (2013.01)

(58) Field of Classification Search
CPC combination set(s) only.
See application file for complete search history.

(56) References Cited

U.S. PATENT DOCUMENTS 1,346,417 A * 7/1920 Palmgren ..... F16O 19/545 384/517
2,301,105 A 11/1942 Yost
4,372,622 A 2/1983 Cheek
4,518,049 A 5/1985 Baldenko et al.
6,158,533 A * 12/2000 Gillis ..... E21B 7/068 175/325.1
2004/0129457 A1 7/2004 McNeilly
2007/0000695 A1 1/2007 Laflin
2011/0012455 A1 1/2011 Scott
2017/0009809 A1* 1/2017 Tanaka ..... F16O 33/046

OTHER PUBLICATIONS

International Search report and Written Opinion dated Jul. 15, 2019, from Applicant's counterpart International Patent Application No. PCT/US2019/23858.

* cited by examiner

*Primary Examiner* — Taras P Bemko
*Assistant Examiner* — Ronald R Runyan
(74) *Attorney, Agent, or Firm* — Jones Walker LLP

(57) ABSTRACT

An integrated bearing section includes a mandrel partially disposed within a housing. The bearing section includes spherical members disposed between the mandrel's outer surface and the housing's inner surface. A radial bearing portion is formed by spherical members disposed partially within grooves and engaging a flat profile opposing surface. The grooves may be in the mandrel's outer surface, an outer surface of a mandrel sleeve, the housing's inner surface, or an outer radial bearing's inner surface. The flat profile opposing surface may be on an outer radial bearing's inner surface, the housing's inner surface, the mandrel's outer surface, or a mandrel sleeve's outer surface. A thrust bearing portion is formed by spherical members disposed partially within grooves in two opposing surfaces, such as the mandrel's outer surface or a mandrel sleeve's outer surface, and the housing's inner surface or an outer thrust bearing's inner surface.

9 Claims, 11 Drawing Sheets

INTEGRATED BEARING SECTION AND METHOD

BACKGROUND

In the drilling of oil and gas wells, downhole drilling motors may be connected to a drill string to rotate and steer a drill bit. Conventional drilling motors typically include a top sub, a power assembly, a transmission assembly, and a bearing assembly. Rotation is provided by the power assembly. The transmission assembly transmits torque and speed from the power assembly to a drill bit disposed at a lower end of the drilling motor. The bearing assembly takes up the axial and radial loads imparted on the drill string and the drill bit during drilling.

Conventional bearing assemblies include a mandrel positioned through an upper radial bearing, a thrust bearing, and a lower radial bearing. The arrangement of a thrust bearing placed between two radial bearings is the classical composition of a bearing section as it is known in the mechanical engineering field. The lower end of the mandrel is configured to engage a drill bit. The upper and lower radial bearings each includes an outer sliding member and an inner sliding member having opposing flat profile surfaces. The opposing flat profiles slide along one another as outer and inner sliding members rotate relative to one another. Sliding radial bearings wear due to frictional forces that cause abrasive wear at the contact surfaces. The thrust bearing includes a series of ball bearings disposed within grooves formed by multiple outer thrust members and multiple inner thrust members. The diameters of the ball members of the thrust bearing decrease as they are worn, which causes relative axial movement between the outer and inner thrust members.

In other conventional bearing assemblies, radial bearings are formed with ball or roller bearings to reduce abrasive wear associated with friction. The inner and outer members of radial ball bearings each includes a groove, and each ball bearing is disposed within a groove of the inner member and a groove of the outer member. As ball bearings of the thrust bearing are worn and their diameters decrease, relative axial movement between the outer thrust members and the inner thrust members applies an uneven load on inner members and outer members of the radial bearing. Because of the radial bearing's arrangement with the ball bearings disposed within grooves in the outer members and the inner members, relative axial movement between the outer members and inner members is not allowed. Accordingly, this radial bearing arrangement fails as the thrust bearing is worn.

DETAILED DESCRIPTION OF THE PREFERRED EMBODIMENTS

Figure 1:
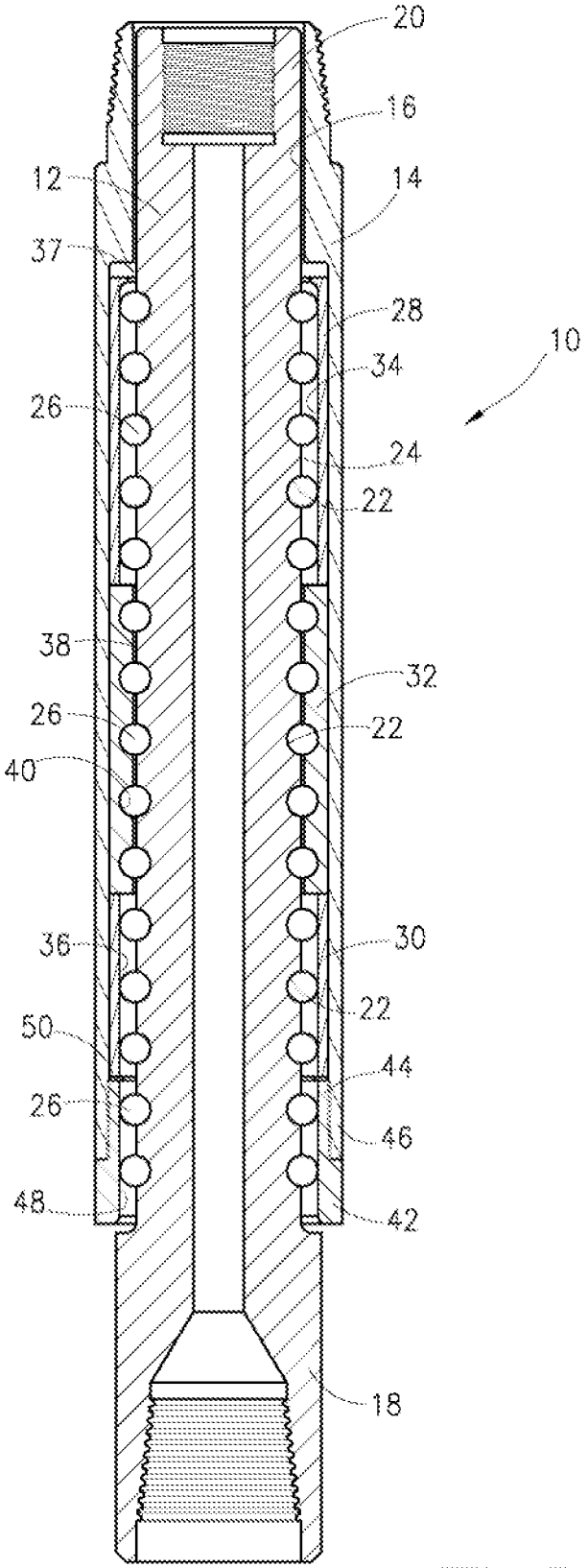
FIG. 1 is a cross-sectional view of an integrated bearing section including a mandrel with grooves.

An integrated bearing section includes a mandrel at least partially disposed within an inner bore of a housing. The bearing section includes a plurality of spherical members disposed between an outer surface of the mandrel and an inner surface of the housing. At least one radial bearing portion of the bearing section is formed by one or more spherical members disposed partially within grooves in the outer surface of the mandrel, an outer surface of a mandrel sleeve disposed around the mandrel, or an inner surface of the housing. The one or more spherical members of the radial bearing portion directly engage a flat profile surface opposing the grooves, such as a flat profile surface on an inner surface of an outer radial bearing, a flat profile surface on an inner surface of the housing, a flat profile surface on an outer surface of the mandrel, or a flat profile surface on an outer surface of a mandrel sleeve disposed around the mandrel. At least one thrust bearing portion of the bearing section is formed by one or more spherical members disposed partially within grooves in an outer surface of the mandrel or an outer surface of a mandrel sleeve that is disposed around the mandrel, and within grooves in an inner surface of the housing or an inner surface of an outer thrust bearing.

In one embodiment, an outer surface of the mandrel includes a series of circumferential grooves. Each of a plurality of spherical members is partially disposed within one of the circumferential grooves in the outer surface of the mandrel. The integrated bearing section also includes an outer radial bearing and an outer thrust bearing each disposed around the mandrel and within the inner bore of the housing. The outer radial bearing has a flat profile inner surface, while the outer thrust bearing has an inner surface including a circumferential groove. At least one of the spherical members engages the flat profile inner surface of the outer radial bearing, and at least one of the spherical members engages the circumferential groove of the outer thrust bearing. Each spherical member engaging the inner surface of the outer radial bearing is permitted to roll along the flat profile, thereby providing for relative axial movement between the outer radial bearing and the mandrel without the radial bearing absorbing any thrust load.

In a further embodiment, the series of circumferential grooves may be disposed on an outer surface of a mandrel sleeve that is positioned around a mandrel. Each of the plurality of spherical members is partially disposed within one of the circumferential grooves in the outer surface of the mandrel sleeve. The mandrel sleeve may be formed of a single integrated sleeve or two or more separate sleeve portions.

In another embodiment, the outer surface of the mandrel includes at least one circumferential groove and a flat profile section. An inner surface of the housing includes at least one circumferential groove. The radial bearing portion is formed by one or more of the spherical members disposed partially within the circumferential groove(s) in the inner surface of the housing, and engaging the flat profile section of the outer surface of the mandrel. These spherical members are permitted to roll along the flat profile section of the mandrel, thereby providing for relative axial movement between the housing and the mandrel. The thrust bearing portion is formed by one or more of the spherical members disposed partially within the circumferential groove(s) in the outer surface of the mandrel, and engaging a circumferential groove in an inner surface of an outer thrust bearing, which is disposed around the mandrel and within the inner bore of the housing.

In a further embodiment, the inner surface of the housing includes at least one circumferential groove. The radial bearing portion is formed by one or more of the spherical members disposed partially within the circumferential groove in the inner surface of the housing, and engaging a flat profile outer surface of a mandrel sleeve, which is disposed around the mandrel. These spherical members are permitted to roll between the housing and the mandrel sleeve, thereby providing for relative axial movement between the housing and the mandrel.

The outer thrust bearing in each embodiment may be formed of two semi-cylindrical members (or "half shells") forming a continuous bearing member or by a series of rings. In a further embodiment, the outer radial bearing and the outer thrust bearing may be integrally formed by two semi-cylindrical members (or "half shells") forming an outer integral bearing. The integral bearing section may include more than one radial bearing portion and/or more than one thrust bearing portion, with each of the portions including any combination of the features described.

With reference to FIG. 1, integrated bearing section 10 for a mud lubricated drilling motor may include mandrel 12 and housing 14. Mandrel 12 may be disposed partially within housing inner bore 16 of housing 14. Mandrel 12 may be formed of a generally cylindrical member including expanded diameter lower end 18 configured to engage and transmit torque to a drill bit. Upper end 20 of mandrel 12 may be configured to engage and receive torque from a transmission assembly of a drilling motor. An outer surface of the mandrel includes a series of circumferential grooves. For example, mandrel 12 includes circumferential grooves 22 along the length of outer surface 24. Each circumferential groove 22 may extend around the circumference of mandrel 12, and have a generally semi-circular profile as shown in FIG. 1.

Integrated bearing section 10 may include a plurality of spherical members 26 (or ball bearings) each partially disposed within one of circumferential grooves 22. Each spherical member 26 may have a radius that is no more than a radius of the circumferential groove 22 within which the spherical member 26 is disposed. For example, each spherical member 26 may have a radius that is approximately equal to or slightly less than a radius of the axial cross section of the corresponding circumferential groove 22. Each spherical member 26 may be formed of steel, ceramics, or any other hard metals.

Integrated bearing section 10 may further include one or more outer radial bearings and one or more outer thrust bearings disposed around mandrel 12 and within housing inner bore 16. For example, outer radial bearings 28, 30 and outer thrust bearing 32 may each be disposed around mandrel 12 and within housing inner bore 16. In this embodiment, outer thrust bearing 32 is disposed between outer radial bearing 28 and outer radial bearing 30, but the integrated bearing section may include any number, combination, and configuration of outer radial bearings and outer thrust bearings.

Outer radial bearings 28 and 30 may each be formed of a cylindrical sleeve having flat profile inner surfaces 34 and 36, respectively. At least one of the spherical members 26 engages each of flat profile inner surfaces 34, 36 of outer radial bearings 28, 30, respectively. In this way, spherical members 26 are positioned in a space between mandrel 12 and outer radial bearings 28 and 30, respectively. Any number of spherical members 26 may be disposed between mandrel 12 and outer radial bearings 28, 30 (e.g., two to one hundred each). As mandrel 12 rotates relative to outer radial bearings 28, 30, each of these spherical members 26 may rotate within circumferential grooves 22 of mandrel 12 and may freely travel in an axial direction on flat profile inner surfaces 34, 36. In this way, integrated bearing section 10 allows relative axial movement between mandrel 12 and outer radial bearings 28, 30 without outer radial bearings 28, 30 absorbing any thrust load. Inner surface 34 of outer radial bearing 28 may include shoulder 37 to limit the extent of the relative axial movement between outer radial bearing 28 and mandrel 12. Inner surface 34 and 36 of outer radial bearing 28 and 30 may be formed of hardened metal layer (e.g., a layer of metal that has been surface hardened by heat treatment) or a wear resistant surface layer composed of a metal or a ceramic.

Inner surface 38 of outer thrust bearing 32 includes at least one circumferential groove 40. Each circumferential groove 40 may extend around the circumference of inner surface 38, and have a generally semi-circular profile as shown in FIG. 1. At least one of the spherical members 26 engages each of the circumferential grooves 40 in outer thrust bearing 32. In this way, at least one spherical member 26 is disposed partially in one of the circumferential grooves 22 in mandrel 12 and partially in one of the circumferential grooves 40 of outer thrust bearing 32. Outer thrust bearing 32 absorbs a thrust load acting on mandrel 12 or housing 14 through the spherical member 26 and circumferential grooves 22 and 40. In the embodiment illustrated in FIG. 1, outer thrust bearing 32 is formed of two semi-cylindrical members (or "half-shells") to allow assembly of integrated bearing section 10.

Referring still to FIG. 1, integrated bearing section 10 may further include nut member 42 disposed around mandrel 12 and below housing 14. Nut member 42 may be formed of a generally cylindrical member having a threaded upper end. Specifically, upper end 44 of nut member 42 may be threadedly secured to lower end 46 of housing 14. Nut member 42 and housing 14 may together form a housing assembly. Nut member 42 may include flat profile inner surface 48, which may be engaged by at least one spherical member 26. In this way, nut member 42 functions as a radial bearing within integrated bearing section 10. Retaining ring 50 may be disposed around mandrel 12 and within housing inner bore 16, and may abut upper end 44 of nut member 42 to retain mandrel 12 within inner bore 16 of housing 14. Outer radial bearing 30 may abut retaining ring 50 such that retaining ring 50 supports and retains outer radial bearing 30, outer thrust bearing 32, and outer radial bearing 28 within housing inner bore 16.

Integrated bearing sections 10 may be assembled by first sliding nut member 42 over upper end 20 of mandrel 12 and along the length of mandrel 12. Spherical members 26 may be positioned within the lowest circumferential grooves 22 of mandrel 12 before sliding nut member 42 over these circumferential grooves 22. In this way, spherical members 26 are secured within the lowest circumferential grooves 22. Retaining ring 50 may then be positioned around mandrel 12. Spherical members 26 may be positioned within circumferential grooves 22 in mandrel 12 before sliding outer radial bearings 30 and 28 over mandrel 12 from its upper end 20, thereby securing spherical members 26 in circumferential grooves 22 and within outer radial bearings 30 and 28. Spherical members 26 may be positioned within circumferential grooves 22 before the two semi-cylindrical members of outer thrust bearing 32 are positioned around mandrel 12 over these circumferential grooves 22. With all of these components in place, a user may slide housing 14 over upper end 20 of mandrel 12, outer radial bearing 28, outer thrust bearing 32, and outer radial bearing 30 until lower end 46 of housing 14 reaches upper end 44 of nut member 42. Lower end 46 of housing 14 is then threadedly secured to upper end 44 of nut member 42 to secure all components to mandrel 12.

During operations, mandrel 12 rotates relative to outer radial bearings 28, 30 and outer thrust bearing 32. As spherical members rotate within circumferential grooves 22 of mandrel 12, spherical members 26 may wear due to the presence of additives and drill cuttings in drilling mud traveling through the bearing section and through normal abrasive wear between spherical members 26 and outer thrust bearing 32. The wear on spherical members 26 may reduce the diameter of each spherical member 26. Additionally, the surfaces of circumferential grooves 22 of mandrel 12 and/or circumferential grooves 40 of outer thrust bearing 32 may also wear, leading to an increase in the size of these circumferential grooves. Both types of wear cause circumferential grooves 22 of mandrel 12 to become unaligned with circumferential grooves 40 of outer thrust bearing 32, resulting in relative axial movement between mandrel 12 and outer thrust bearing 32 and outer radial bearings 28, 30. In response, spherical members 26 may move freely over flat profile inner surfaces 34 and 36 of outer radial bearings 28 and 30 to allow relative axial movement between mandrel 12 and outer radial bearings 28, 30 without the spherical members 26 that engage flat profile inner surfaces 34 and 36 of outer radial bearings 28 and 30 absorbing any axial load. This arrangement renders integrated bearing section 10 more durable with wear than conventional ball bearing sections because it leads to less frequent failure of spherical members 26 that engage outer radial bearings 28, 30.

Figure 2:
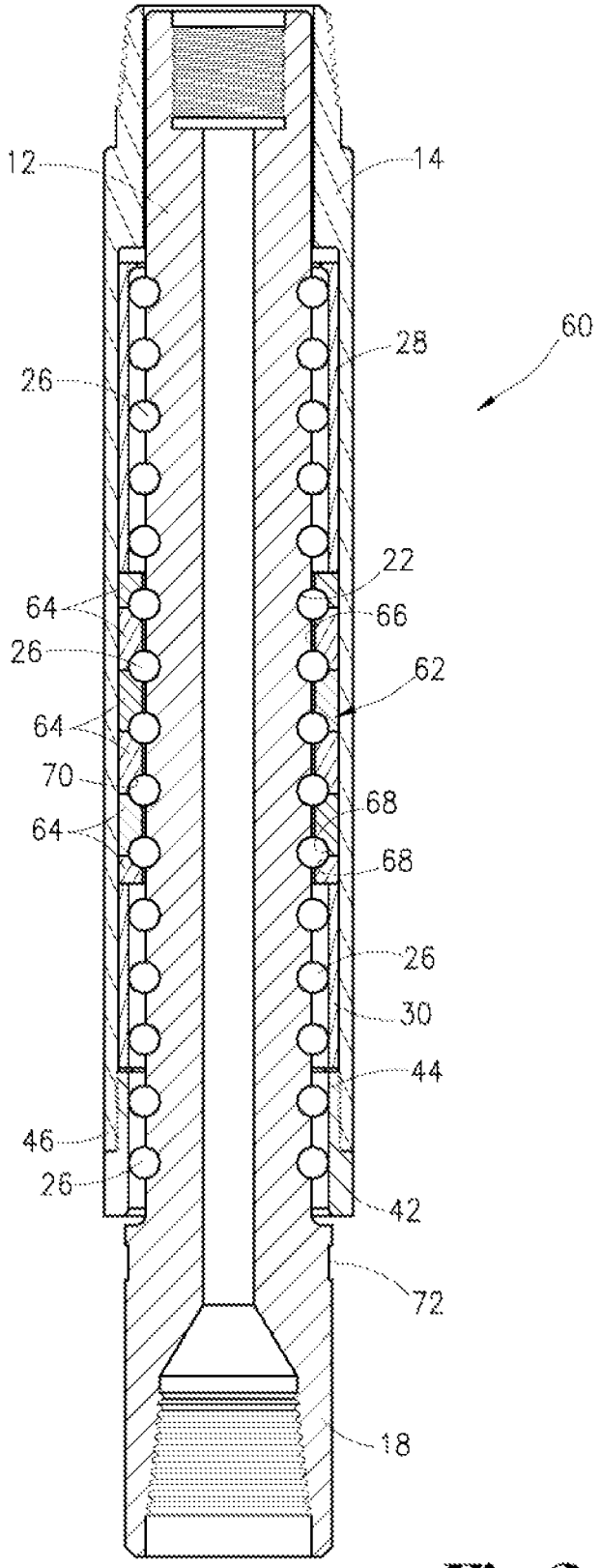
FIG. 2 is a cross-sectional view of an alternate embodiment of the integrated bearing section including the mandrel with grooves.

FIG. 2 illustrates integrated bearing section 60, an alternate embodiment of the integrated bearing section of the present disclosure. Except as otherwise noted, integrated bearing section 60 includes the same features and functions in the same manner described above in connection with integrated bearing section 10, with the same reference numerals indicating the same structure and function described above. Integrated bearing section 60 includes outer thrust bearing 62 including a series of rings 64. Inner surfaces 66 of rings 64 may each include one or more partial grooves 68 that cooperate with partial grooves 68 of adjacent rings 64 to form circumferential grooves 70 when rings 64 are stacked. In this way, the inner surface of outer thrust bearing 62 includes at least one circumferential groove 70 with at least one of the spherical members 26 partially disposed within each circumferential groove 70. Each circumferential groove 70 may have a generally semi-circular profile. The axial cross section of each circumferential groove 70 may have a radius that is approximately equal to or slightly greater than a radius of each of the spherical members 26 disposed therein. The number of circumferential grooves 70 of outer thrust bearing 62 may be one less than the number of rings 64 in outer thrust bearing 62. The series of rings 64 together form outer thrust bearing 62, which absorbs a thrust load acting on mandrel 12 and housing 14 through the spherical members 26 and circumferential grooves 22 and 70.

Integrated bearing section 60 may be assembled in the same way described above in connection with integrated bearing section 10 with the exception of the assembly of the outer thrust bearing components. For integrated bearing section 60, nut member 42 and outer radial bearing 30 may first be placed over spherical members 26 and mandrel 12. Then a user may slide a first ring 64 of outer thrust bearing 62 over mandrel 12 and position spherical members 26 within circumferential grooves 22 of mandrel 12 and partial groove 68 of the first ring 64 before sliding the next ring 64 over mandrel 12 to abut the first ring 64. The outer surface of mandrel 12 may include a tapered or attenuated profile adjacent to each circumferential groove 22 to assist in positioning each spherical member 26 within the circumferential groove 22. This process is repeated for each ring 64 of outer thrust bearing 62. In this way, the spherical members 26 are secured within circumferential grooves 70 of outer thrust bearing 62. Next spherical members 26 are positioned within upper circumferential grooves 22 in mandrel 12 before sliding outer radial bearing 28 over this section of mandrel 12. Finally, a user may slide housing 14 over upper end 20 of mandrel 12, outer radial bearing 28, outer thrust bearing 62, and outer radial bearing 30 until lower end 46 of housing 14 reaches upper end 44 of nut member 42. Lower end 46 of housing 14 is then threadedly secured to upper end 44 of nut member 42 to secure all components to mandrel 12.

As shown in FIG. 2, lower end 18 of mandrel 12 may include first indication band 72 to indicate the use of a first size of spherical members 26. First indication band 72 may be formed by a recess in lower end 18 of mandrel 12. As mandrel 12 rotates relative to outer radial bearings 28, 30 and outer thrust bearing 62, the surfaces of circumferential grooves 22 of mandrel 12 and/or circumferential grooves 70 of outer thrust bearing 62 may wear along with wear on spherical members 26. As described above in connection with integrated bearing section 10, both types of wear cause relative axial movement between mandrel 12 and outer radial bearings 28, 30 and outer thrust bearing 62. Once the relative axial movement reaches a threshold level, integrated bearing section 60 may be removed from use for maintenance. The maintenance may include disassembling integrated bearing section 60 by following the described assembly steps in the reverse order.

Figure 3:
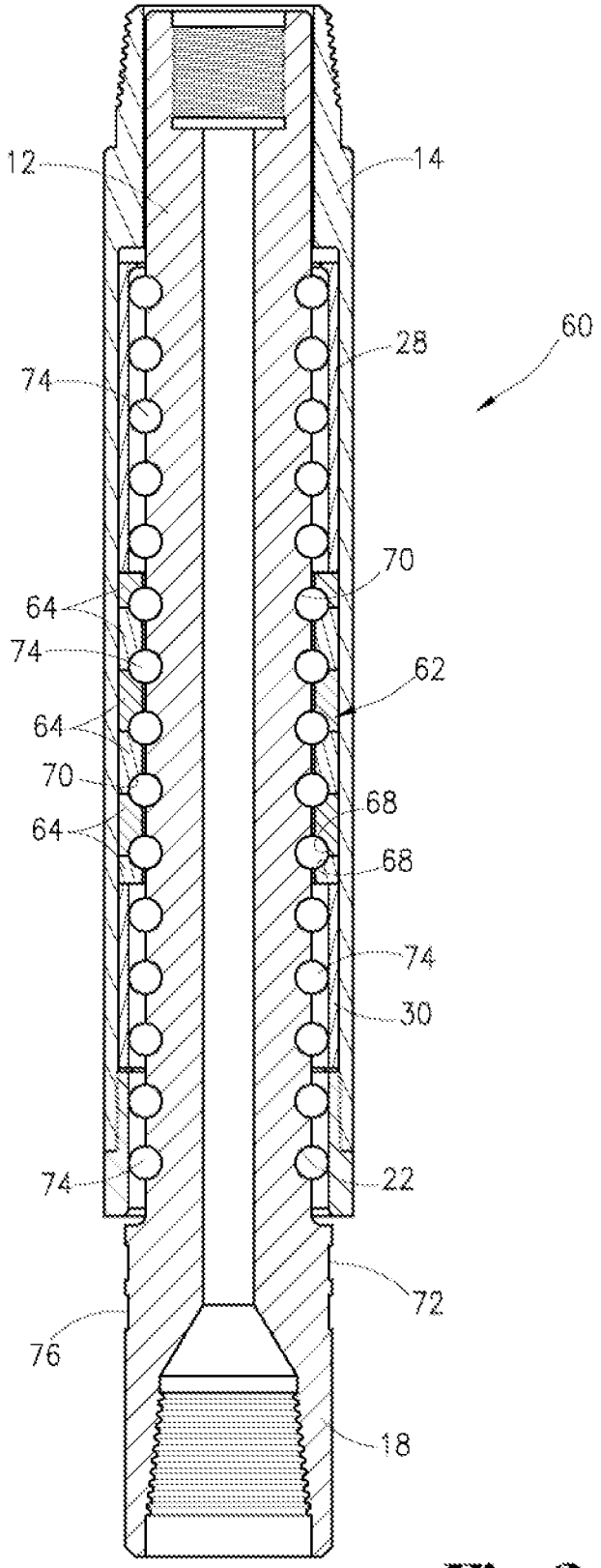
FIG. 3 is a cross-sectional view of the integrated bearing section of FIG. 2 with larger spherical members in the grooves of the mandrel.

With reference to FIG. 3, each of the circumferential grooves 22 in mandrel 12 may be machined to a second radius size to house larger spherical members 74. The second radius size of the axial cross section of circumferential grooves 22 may be approximately equal to or slightly larger than a radius of each of the larger spherical members 74. Additionally, each of the partial grooves 68 of the rings 64 of outer thrust bearing 62 may be machined to the second radius size that is approximately equal to or slightly larger than the radius of each of the larger spherical members 74.

Second indication band 76 may be added to lower end 18 of mandrel 12 to indicate the presence of larger circumferential grooves 22 and the use of larger spherical members 74. Second indication band 76 may be formed by a recess in lower end 18 of mandrel 12. Integrated bearing section 60 may then be assembled with larger spherical member 74 using the process described above in connection with FIG. 2. This process of adjusting the size of circumferential grooves and using larger spherical members may be applied to any embodiment of the integrated bearing section disclosed herein. In this way, the use of the integrated bearing section may be extended to reduce the cost associated with replacement of the bearing section equipment.

Integrated bearing sections 10 and 60 illustrated in FIGS. 1-3 each includes mandrel 12 circumferential grooves. Because the integrated bearing section in these embodiments requires no inner radial bearing member or inner thrust bearing member, the mandrel may have a greater thickness than in conventional bearing sections, thereby providing a stronger mandrel that is capable of transmitting more torque to the drill bit secured to the lower end of the mandrel.

Figure 4:
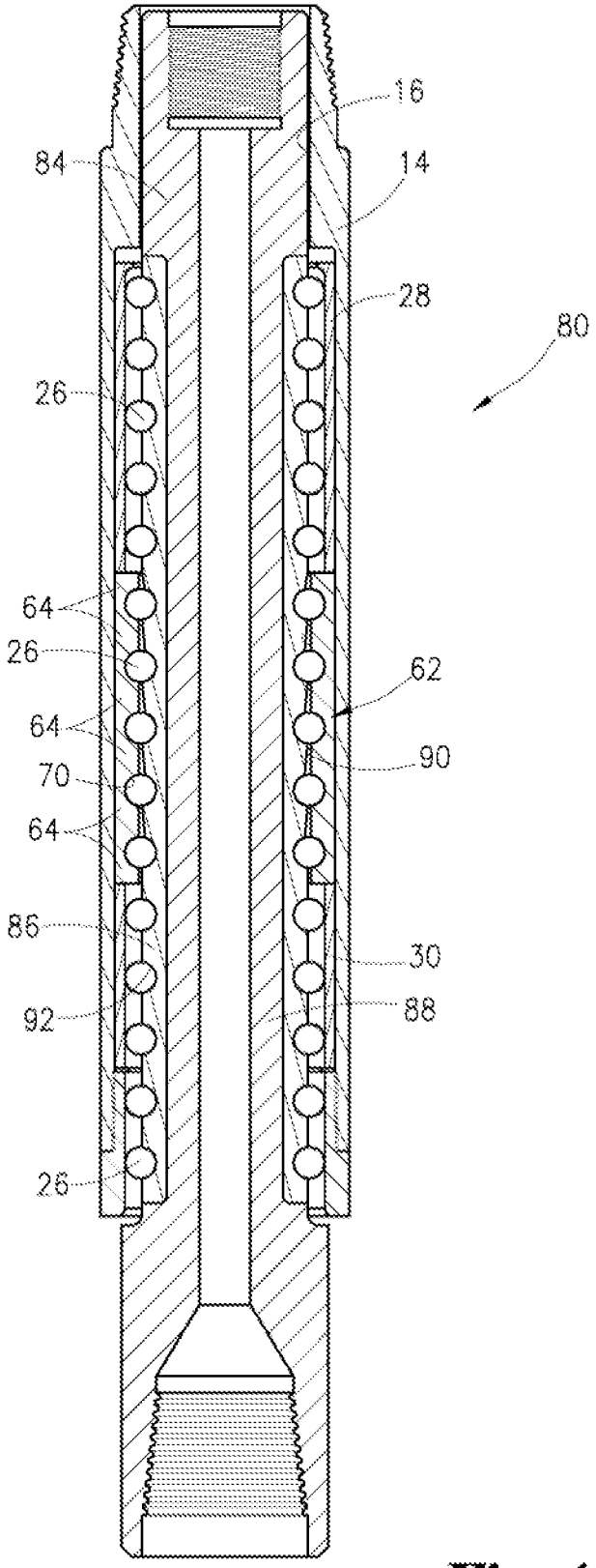
FIG. 4 is a cross-sectional view of an alternate embodiment of the integrated bearing section including a mandrel sleeve with grooves.

With reference to FIG. 4, integrated bearing section 80 is another alternate embodiment of the integrated bearing section of the present disclosure. Except as otherwise noted, integrated bearing section 80 includes the same features and functions in the same manner described above in connection with integrated bearing sections 10 and 60, with the same reference numerals indicating the same structure and function described above. Integrated bearing section 80 in FIG. 4 includes mandrel 84 and mandrel sleeve 86. Mandrel 84 may have the same shape and features as mandrel 12 in FIGS. 1-3, except that mandrel 84 includes restricted diameter section 88 disposed within housing inner bore 16. Mandrel sleeve 86 is disposed around restricted diameter section 88 of mandrel 84 and within housing inner bore 16, outer radial bearings 28, 30, and outer thrust bearing 62. Outer surface 90 of mandrel sleeve 86 includes a series of circumferential grooves 92 extending around the circumference of mandrel sleeve 86 and having a generally semi-circular profile as shown. In this way, the outer surface of mandrel sleeve 86 includes a series of circumferential grooves 92. Each of spherical members 26 are disposed within one of the circumferential grooves 92 of mandrel sleeve 86. Mandrel sleeve 86 and mandrel 84 together rotate relative to outer radial bearings 28, 30 and outer thrust bearing 62. Outer thrust bearing 62 absorbs a thrust load acting on mandrel 84 through mandrel sleeve 86, spherical members 26, and circumferential grooves 70. Mandrel sleeve 86 in integrated bearing section 80 is formed of two semi-cylindrical members (or "half shells"), with each member extending the entire length of restricted diameter section 88 of mandrel 84. Mandrel sleeve 86 in integrated bearing section 80 may be fixed to mandrel 84 by means of clamping, bolting, or welding to prevent a relative rotational movement between mandrel sleeve 86 and mandrel 84.

The assembly of integrated bearing section 80 may first involve the assembly of mandrel 84 and mandrel sleeve 86. Specifically, the two semi-cylindrical members of mandrel sleeve 86 are positioned around restricted diameter section 88 of mandrel 84. Thereafter, integrated bearing section 80 may be assembled in the same way described above in connection with integrated bearing section 60 with spherical members 26 being positioned within circumferential grooves 92 of mandrel sleeve 86.

Figure 5:
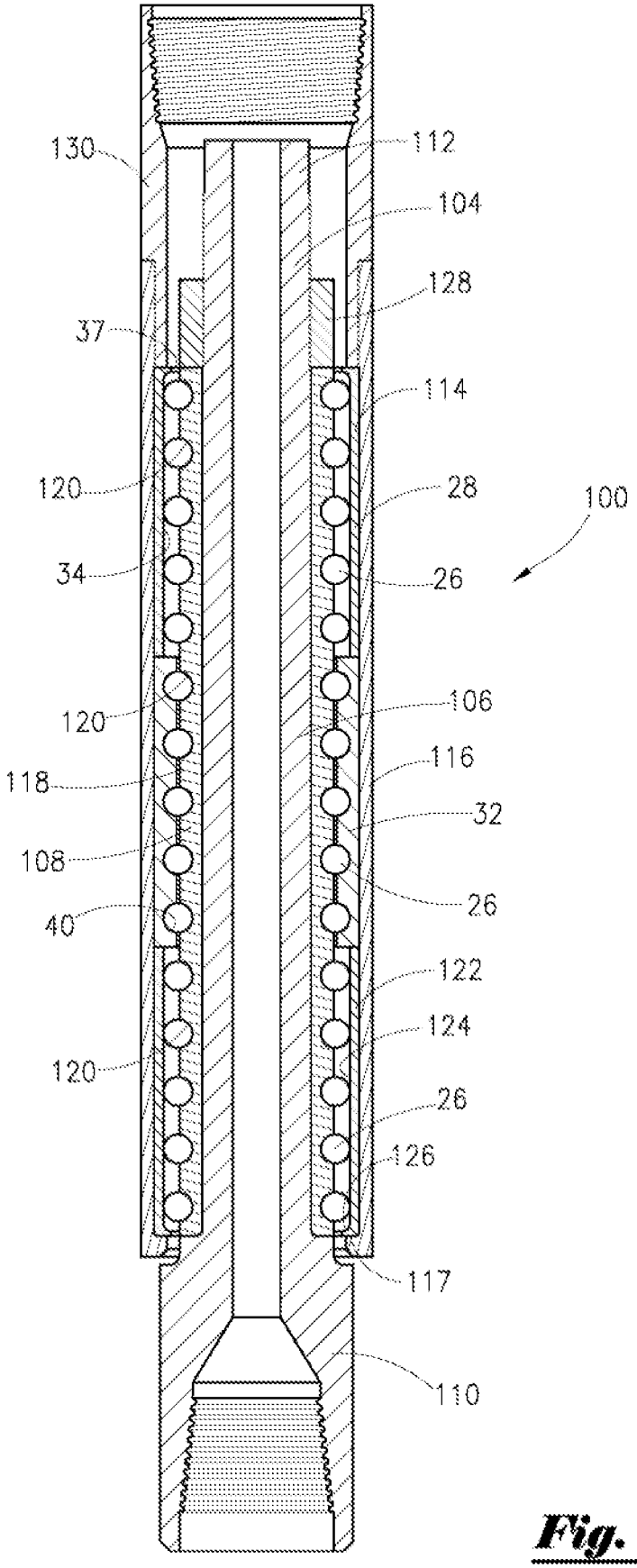
FIG. 5 is a cross-sectional view of another alternate embodiment of the integrated bearing section including the mandrel sleeve with grooves.

FIG. 5 illustrates integrated bearing section 100, an alternate embodiment of the integrated bearing section of the present disclosure. Except as otherwise noted, integrated bearing section 100 includes the same features and functions in the same manner described above in connection with integrated bearing sections 10, 60, and 80, with the same reference numerals indicating the same structure and function described above. Integrated bearing section 100 includes mandrel 104 having restricted diameter section 106 and mandrel sleeve 108 disposed around restricted diameter section 106 of mandrel 104. Mandrel 104 may be formed of a generally cylindrical member including expanded diameter lower end 110 configured to engage and transmit torque to a drill bit. Upper end 112 of mandrel 104 may be configured to engage and receive torque from a transmission assembly of a drilling motor. Mandrel sleeve 108 in this embodiment may be formed of a single cylindrical sleeve that slides over upper end 112 of mandrel 104 for assembly. Mandrel sleeve 108 and a portion of mandrel 104 are disposed within housing inner bore 114 of housing 116. Housing 116 includes lower shoulder 117 configured to retain the various components within housing inner bore 114.

Outer surface 118 of mandrel sleeve 108 may include a series of circumferential grooves 120 extending around the circumference of mandrel sleeve 108 and having a generally semi-circular profile as shown. Each of spherical members 26 is disposed within one of the circumferential grooves 120 of mandrel sleeve 108. Each circumferential groove 120 in mandrel sleeve 108 may have an axial cross section with a radius that is approximately equal to or slightly larger than a radius of the spherical members 26.

Referring still to FIG. 5, integrated bearing section 100 also includes outer radial bearing 28, outer thrust bearing 32, and outer radial bearing 122 each disposed around mandrel sleeve 108 and within housing inner bore 114. Outer radial bearing 122 may be formed of a cylindrical sleeve having flat profile inner surface 124 and shoulder 126 at its lower end. At least one spherical member 26 engages flat profile inner surfaces 34 and 124 of outer radial bearings 28 and 122, respectively. In this way, spherical members 26 are positioned in a space between mandrel sleeve 108 and outer radial bearings 28 and 122. As mandrel sleeve 108 and mandrel 104 together rotate relative to outer radial bearings 28 and 122, each of these spherical members 26 may rotate within circumferential grooves 120 of mandrel sleeve 108 and may freely travel in an axial direction on flat profile inner surfaces 34 and 124 of outer radial bearings 28 and 122. In this way, integrated bearing section 100 allows relative axial movement between mandrel 104 and outer radial bearings 28 and 122 without outer radial bearings 28 and 122 absorbing any thrust load. Shoulders 37 and 126 limit the extent of the relative axial movement between outer radial bearings 28 and 122, respectively, and mandrel 104 and mandrel sleeve 108.

Integrated bearing section 100 may further include nut member 128 configured to be threadedly attached to upper end 112 of mandrel 104. Nut member 128 may abut an upper end of mandrel sleeve 108 to secure mandrel sleeve 108 in place around mandrel 104. Adapter 130 may be threadedly secured to an upper end of housing 116. A lower end of adapter 130 may abut outer radial bearing 28. Accordingly, outer radial bearing 28, outer thrust bearing 32, and outer radial bearing 122 may be secured around mandrel sleeve 108 and within housing inner bore 114 between lower shoulder 117 of housing 116 and adapter 130. Outer thrust bearing 32 absorbs a thrust load acting on mandrel 104 through nut member 128, mandrel sleeve 108, spherical members 26, and circumferential groove 40.

The assembly of integrated bearing section 100 may first involve the assembly of a cartridge unit including mandrel sleeve 108 and outer radial bearings 28, 122 and outer thrust bearing 32. The cartridge unit may be assembled by positioning spherical members 26 in circumferential grooves 120 near the lower end and the upper end of mandrel sleeve 108, and sliding outer radial bearing 122 and 28 over the lower end and the upper end, respectively, of mandrel sleeve 108 to secure spherical members 26 in these circumferential grooves 120. Then spherical member 26 may be positioned in circumferential grooves 120 in the middle section of mandrel sleeve 108, and the two sections of outer thrust bearing 32 (or "half shells") may be secured around mandrel sleeve 108 to secure spherical members 26 in these circumferential grooves 120. The cartridge unit may be stored in its assembled state. A user may slide the cartridge unit (including mandrel sleeve 108, outer radial bearings 28, 122, outer thrust bearing 32, and spherical members 26) into housing inner bore 114 of housing 14 and around mandrel 104. Nut member 128 may then be threadedly secured to upper end 112 of mandrel 104 to secure mandrel sleeve 108 around mandrel 104. Finally, adapter 130 may be threadedly secured to an upper end of housing 116. In this way, outer radial bearings 28, 122 and outer thrust bearing 32 are secured within housing inner bore 114 between lower shoulder 117 and adapter 130.

Figure 6:
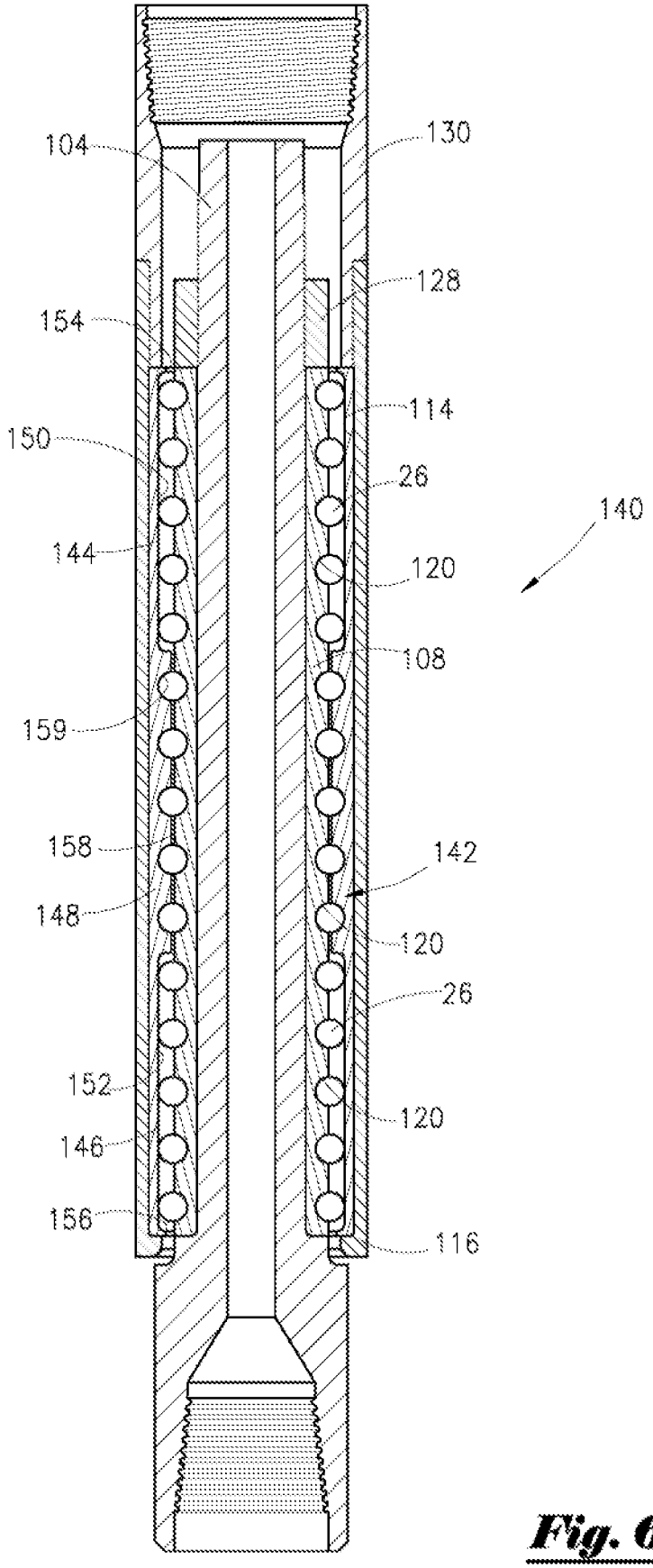
FIG. 6 is a cross-sectional view of a further embodiment of the integrated bearing section including the mandrel sleeve with grooves and an outer integral bearing.

FIG. 6 illustrates integrated bearing section 140, an alternate embodiment of the integrated bearing section of the present disclosure. Except as otherwise noted, integrated bearing section 140 includes the same features and functions in the same manner described above in connection with integrated bearing sections 100, with the same reference numerals indicating the same structure and function described above. Integrated bearing section 140 includes outer integral bearing 142 disposed around mandrel sleeve 108 and within housing inner bore 114. Outer integral bearing 142 includes outer radial bearing sections 144 and 146 and outer thrust bearing section 148. Outer radial bearing sections 144, 146 include flat profile inner surfaces 150, 152 and shoulders 154, 156, respectively. Outer thrust bearing section 148 includes inner surface 158 having at least one circumferential groove 159. Circumferential grooves 159 may each extend around the circumference of inner surface 158, and may have a generally semi-circular shape with a radius of the axial cross section that is approximately equal to or slightly larger than a radius of spherical members 26. In this way, the outer radial bearing and outer thrust bearing of integrated bearing section 140 are integrally formed. Outer integral bearing 142 may be formed of two semi-cylindrical members (or "half shells").

At least one spherical member 26 engages each of flat profile inner surfaces 150, 152 of outer radial bearing sections 144, 146 and circumferential groove 159 in outer thrust bearing section 148. In this way, spherical members 26 are positioned in a space between mandrel sleeve 108 and outer integral bearing 142. As mandrel 104 and mandrel sleeve 108 together rotate relative to outer integral bearing 142, each of the spherical members 26 engaging flat profile inner surfaces 150, 152 may rotate within circumferential grooves 120 of mandrel sleeve 108 and may freely travel in an axial direction on flat profile inner surfaces 150, 152. In this way, integrated bearing section 140 allows relative axial movement between mandrel 104 and outer integral bearing 142 (as the surface of circumferential grooves and the spherical members wear). Outer thrust bearing section 148 of outer integral bearing 142 absorbs a thrust load acting on mandrel 104 through mandrel sleeve 108, spherical members 26, and circumferential grooves 159.

The assembly of integrated bearing section 140 may first involve the assembly of a cartridge unit including mandrel sleeve 108, outer integral bearing 142, and spherical members 26. The cartridge unit may be assembled by positioning spherical members 26 within each of circumferential grooves 120 in mandrel sleeve 108, and securing the two sections of outer integral bearing 142 (or "half shells") around mandrel sleeve 108 to secure spherical member 26 in the circumferential grooves 120 of mandrel sleeve 108 with at least one spherical member 26 in a circumferential groove 159. The cartridge unit may be stored in its assembled state. The cartridge unit may be inserted into housing inner bore 114 of housing 116 and around mandrel 104 in the same manner described above in connection with integrated bearing section 100. This assembly may be accomplished by first inserting or sliding the cartridge unit into housing inner bore 114 of housing 116, then inserting or sliding the mandrel 104 into or through a central portion of mandrel sleeve 108 of the cartridge unit. Alternatively, this assembly may be accomplished by first inserting or sliding the cartridge unit over mandrel 104, then sliding housing 116 over the cartridge unit to position the cartridge unit within housing inner bore 114.

The cartridge units of integrated bearing section 100 and integrated bearing section 140 may reduce costs by decreasing the time required to repair or perform maintenance on a bearing section. The cartridge units may be built, assembly, and stored as an assembled unit to quickly replace an existing cartridge unit in the integrated bearing section. In this way, the cartridge units provide replacement parts for the bearing sections.

Figure 7:
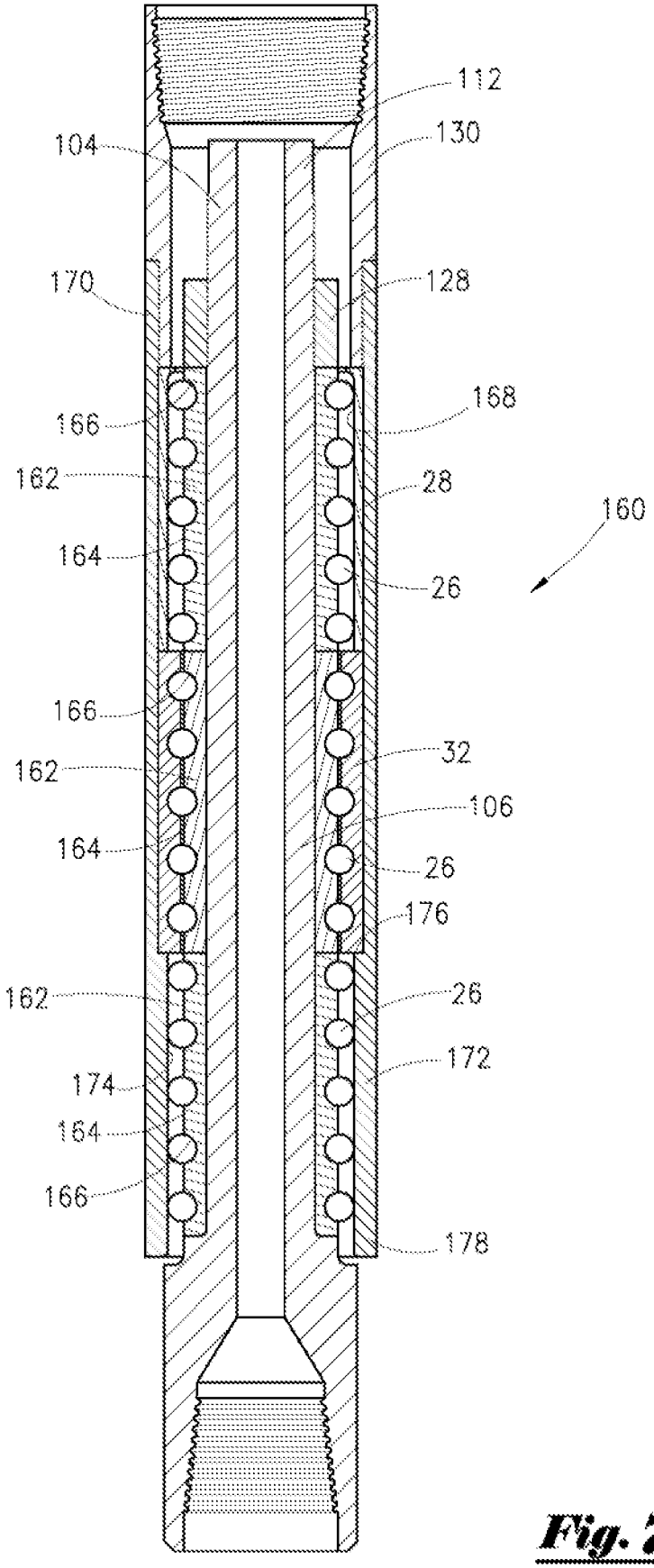
FIG. 7 is a cross-sectional view of an alternate embodiment of the integrated bearing section including separate mandrel sleeves with grooves.

FIG. 7 illustrates integrated bearing section 160, an alternate embodiment of the integrated bearing section of the present disclosure. Except as otherwise noted, integrated bearing section 160 includes the same features and functions in the same manner described above in connection with integrated bearing sections 100, with the same reference numerals indicating the same structure and function described above. Integrated bearing section 160 includes mandrel 104 and mandrel sleeves 162. Each mandrel sleeve 162 may be formed of a cylindrical sleeve that slides over upper end 112 of mandrel 104 to be positioned around restricted diameter section 106 of mandrel 104. Outer surface 164 of each mandrel sleeve 162 may include a series of circumferential grooves 166 extending around the circumference of the respective mandrel sleeve 162 and having a generally semi-circular profile as shown. Each of spherical members 26 is disposed within one of the circumferential grooves 166 of one of the mandrel sleeves 162. Each circumferential groove 166 in mandrel sleeves 162 may include an axial cross section with a radius that is approximately equal to or slightly larger than a radius of the spherical members 26.

Mandrel sleeves 162 and a portion of mandrel 104 are disposed within housing inner bore 168 of housing 170. Housing 170 includes housing lower portion 172 having flat profile inner surface 174 extending from shoulder 176 to lower end 178 of housing 170. Outer radial bearing 28 and outer thrust bearing 32 are disposed around mandrel sleeves 162 and within housing inner bore 168 above shoulder 176. Shoulder 176 abuts outer thrust bearing 32 to retain outer thrust bearing 32 and outer radial bearing 28 within housing inner bore 168. An upper radial bearing portion of integrated bearing section 160 is formed by one or more spherical members 26 disposed partially within circumferential grooves 166 of mandrel sleeve 162 and engaging the flat profile inner surface of outer radial bearing 28. A lower radial bearing portion of integrated bearing section 160 is formed by one or more spherical members 26 disposed partially within circumferential grooves 166 of another mandrel sleeve 162 and engaging flat profile inner surface 174 of housing lower portion 172. As mandrel sleeves 162 and mandrel 104 rotate together relative to outer radial bearing 28 and housing lower portion 172, each of these spherical members 26 may rotate within circumferential grooves 166 of the respective mandrel sleeves 162 and may freely travel in an axial direction along the flat profile inner surface of outer radial bearing 28 and flat profile inner surface 174 of housing lower portion 172. In this way, integrated bearing section 160 allows relative axial movement between mandrel 104 and outer radial bearing 28 and between mandrel 104 and housing 170 without outer radial bearing 28 or housing 170 absorbing any thrust load.

The assembly of integrated bearing section 160 may first involve the assembly of two cartridge units. One cartridge unit may be assembled by positioning spherical members 26 in circumferential grooves 166 of a mandrel sleeve 162 and sliding outer radial bearing 28 over the upper end of the mandrel sleeve 162 to secure spherical members 26 in these circumferential grooves 166. The second cartridge unit may be assembled by positioning spherical members 26 in circumferential grooves 166 of another mandrel sleeve 162 and securing the two sections of outer thrust bearing 32 (or "half shells") around the mandrel sleeve 162 to secure spherical members 26 in these circumferential grooves 166. Both cartridge units may be stored in the assembled state. A user may slide a third mandrel sleeve 162 over upper end 112 of mandrel 104, and position spherical members 26 in circumferential grooves 166 of this mandrel sleeve 162. The user may slide the second cartridge unit and the first cartridge unit into housing inner bore 168, and then slide housing 170 with the second and first cartridge over the upper end 112 of mandrel, sliding mandrel 104 into housing inner bore 168 to secure spherical members 26 in these circumferential grooves 166 and within housing lower portion 172. Nut member 128 may then be threadedly secured to upper end 112 of mandrel 104 to secure all mandrel sleeves 162 around mandrel 104. Finally, adapter 130 may be threadedly secured to an upper end of housing 170. In this way, outer radial bearing 28 and outer thrust bearing 32 are secured within housing inner bore 168 between shoulder 176 and adapter 130.

Figure 8:
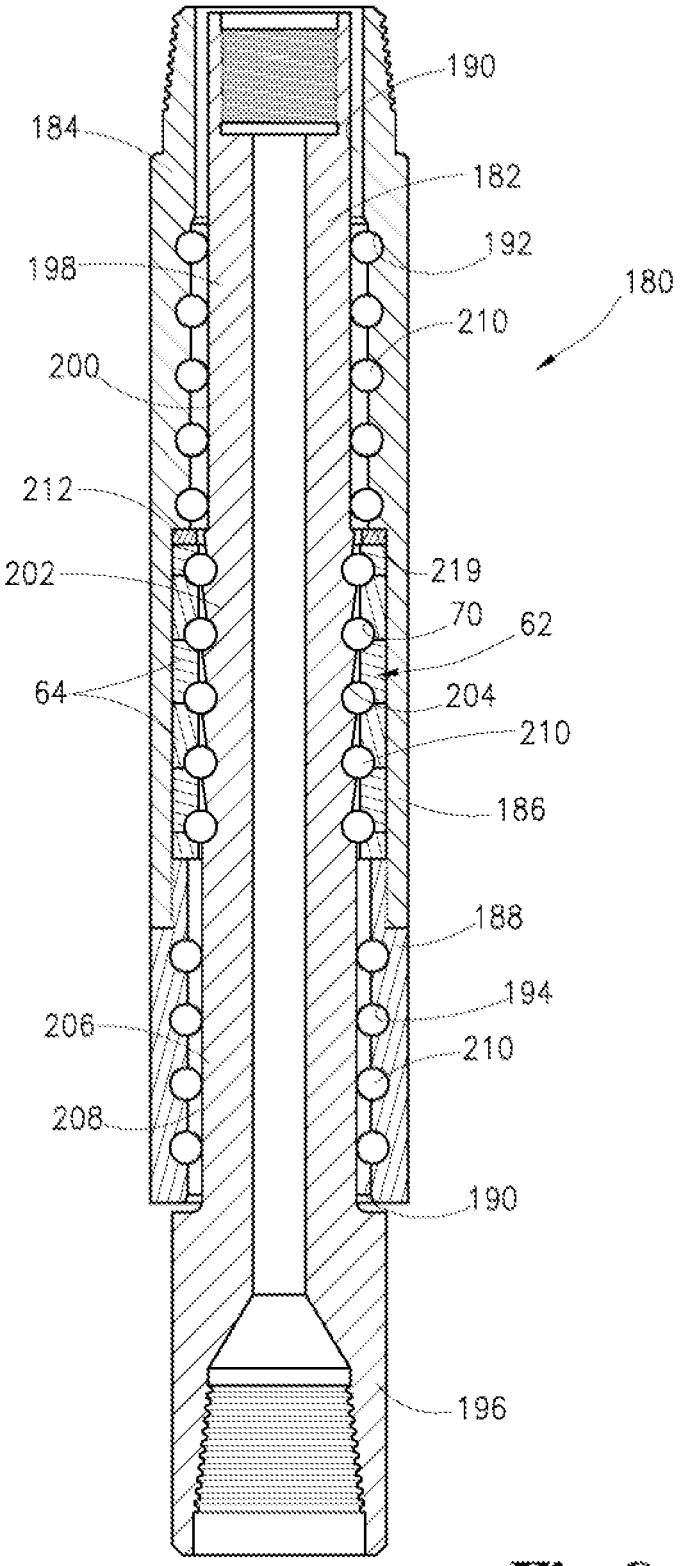
FIG. 8 is a cross-sectional view of an alternate embodiment of the integrated bearing section including a mandrel with grooves and a housing with grooves.

With reference to FIG. 8, integrated bearing section 180 is an alternate embodiment of the integrated bearing section of the present disclosure. Except as otherwise noted, integrated bearing section 180 includes the same features and functions in the same manner described above in connection with integrated bearing sections 10, 60, and 80, with the same reference numerals indicating the same structure and function described above. Integrated bearing section 180 includes mandrel 182 and housing 184. Housing 184 includes upper housing 186 and lower housing 188, which may be threadedly connected. Lower housing 188 may function in a similar manner to nut member 42 in FIG. 1. Housing inner bore 190 may run through upper housing 186 and through lower housing 188. Upper housing 186 may include circumferential grooves 192 on its inner surface in a first section. A second section of upper housing 186 may include a flat profile inner surface. Lower housing 188 may also include circumferential grooves 194 on its inner surface.

Mandrel 182 may be disposed partially within housing inner bore 190 through upper and lower housings 186 and 188. Mandrel 182 may be formed of a generally cylindrical member including expanded diameter lower end 196 configured to engage and transmit torque to a drill bit. The upper end of mandrel 182 may be configured to engage and receive torque from a transmission assembly of a drilling motor. First section 198 of mandrel 182 includes flat profile outer surface 200. Second section 202 of mandrel 182 includes a series of circumferential grooves 204 in its outer surface. Each circumferential groove 204 may extend around the circumference of mandrel 182, and have a generally semicircular profile as shown. Third section 206 of mandrel 182 includes flat profile outer surface 208.

Integrated bearing section 180 may also include outer thrust bearing 62 including a series of rings 64 and a plurality of spherical members 210 disposed in the annular space between mandrel 182 and housing 184. Outer thrust bearing 62 is disposed around second section 202 of mandrel 182 within housing inner bore 190. Ring 212 may be disposed between an upper end of outer thrust bearing 62 and shoulder 214 of upper housing 186. One or more spherical members 210 may each be partially disposed within one of circumferential grooves 192 of upper housing 186 and engaging flat profile outer surface 200 of first section 198 of mandrel 182. One or more spherical members 210 may each be partially disposed within one of circumferential grooves 194 of lower housing 188 and engaging flat profile outer surface 208 of third section 206 of mandrel 182. As mandrel 182 rotates relative to housing 184, each of these spherical members 210 may rotate within circumferential grooves 192 and 194 of upper and lower housings 186 and 188, and may freely travel in an axial direction on flat profile outer surfaces 200 and 208, respectively. In this way, integrated bearing section 180 allows relative axial movement between mandrel 182 and housing 184 without housing 184 absorbing any thrust load. One or more spherical members 210 may each be partially disposed within one of circumferential grooves 70 of outer thrust bearing 62 and partially disposed within one of circumferential grooves 204 of second section 202 of mandrel 182. Outer thrust bearing 62 absorbs a thrust load acting on mandrel 182 or housing 184 through the spherical members 210 and circumferential grooves 204 and 70.

Integrated bearing section 180 may be assembled by positioning spherical members 210 within circumferential grooves 194 while sliding lower housing 188 over the upper end of mandrel 182 and along the length of mandrel 182 to position lower housing 188 over third section 206 of mandrel 182. In this way, spherical members 210 are secured within circumferential grooves 194. Spherical members 210 may then be positioned within each circumferential groove 204 in second section 202 of mandrel 182, followed by the next ring 64 of outer thrust bearing 62. Next, spherical members 210 may be positioned within circumferential grooves 192 within upper housing 186. Upper housing 186 slides over the upper end of mandrel 182 to position upper housing 186 around outer thrust bearing 62 and to position spherical members 210 within upper housing 186 over first section 198 of mandrel 182. The lower end of upper housing 186 is threadedly secured to the upper end of lower housing 188 to secure all components to mandrel 182. During operations, mandrel 182 rotates relative to outer thrust bearing 62 and upper and lower housings 186 and 188.

Figure 9:
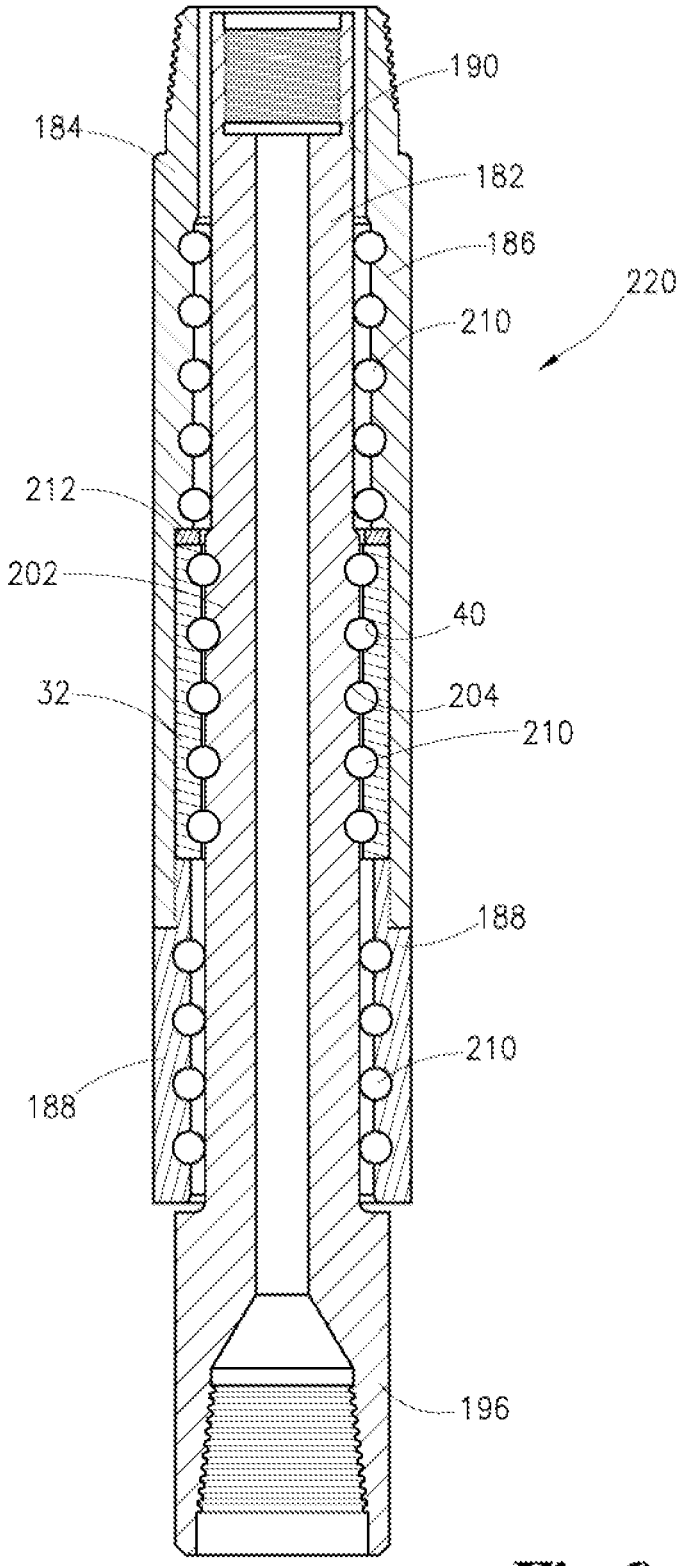
FIG. 9 is a cross-sectional view of an alternate embodiment of the integrated bearing section including a mandrel with grooves and a housing with grooves.

Referring to FIG. 9, integrated bearing section 220 is an alternate embodiment of the integrated bearing section of the present disclosure. Except as otherwise noted, integrated bearing section 220 includes the same features and functions in the same manner described above in connection with integrated bearing sections 180, with the same reference numerals indicating the same structure and function described above. Integrated bearing section 220 includes outer thrust bearing 32 disposed around second section 202 of mandrel 182 and within housing inner bore 190 of upper housing 186. Outer thrust bearing 32 is formed of two semi-cylindrical members (or "half shells") with circumferential grooves 40 in the inner surface of each (as described above in connection with FIG. 1). Spherical members 210 are partially disposed in circumferential grooves 204 of mandrel 182 and are partially disposed within circumferential grooves 40 of outer thrust bearing 32.

Figure 10:
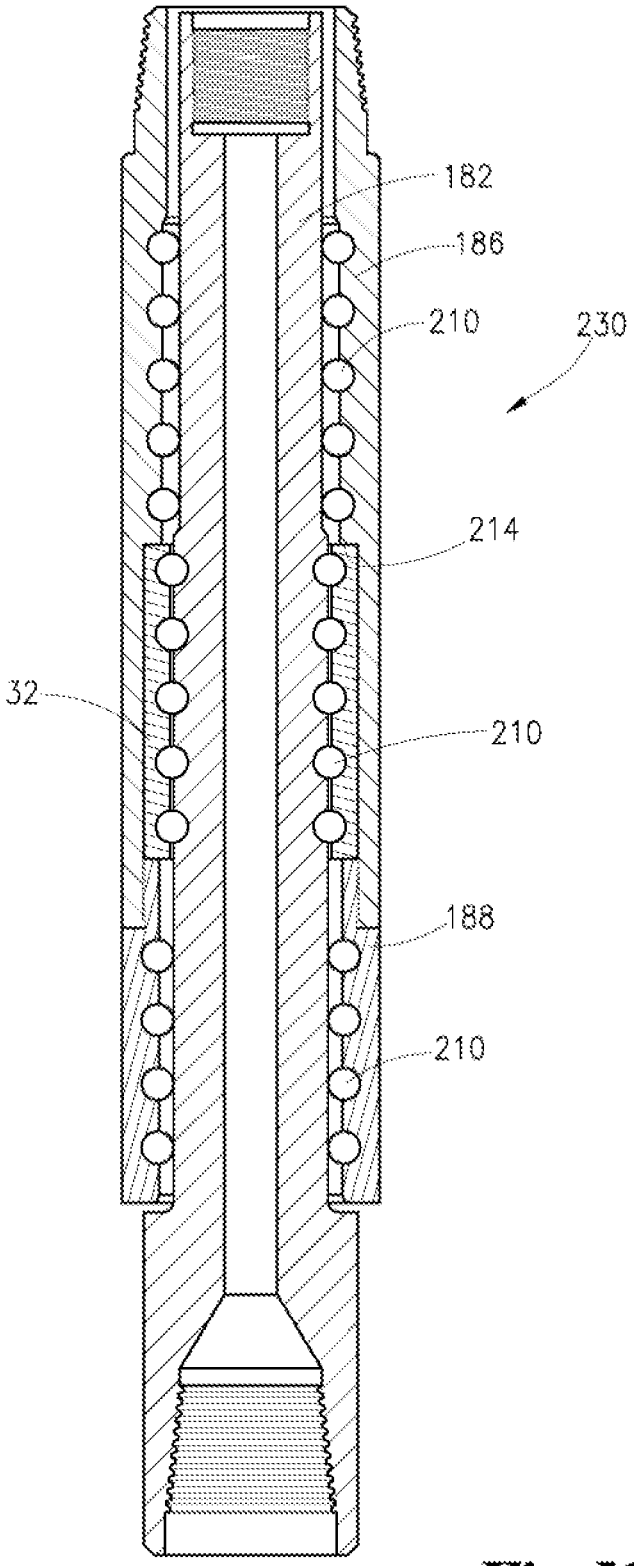
FIG. 10 is a cross-sectional view of an alternate embodiment of the integrated bearing section including a mandrel with grooves and a housing with grooves.

FIG. 10 illustrates integrated bearing section 230, which is another alternate embodiment of the integrated bearing section of the present disclosure. Except as otherwise noted, integrated bearing section 230 includes the same features and functions in the same manner described above in connection with integrated bearing sections 220, with the same reference numerals indicating the same structure and function described above. Integrated bearing section 230 does not include ring 212. Instead, the upper end of outer thrust bearing 32 directly engages shoulder 214 of upper housing 186.

Figure 11:
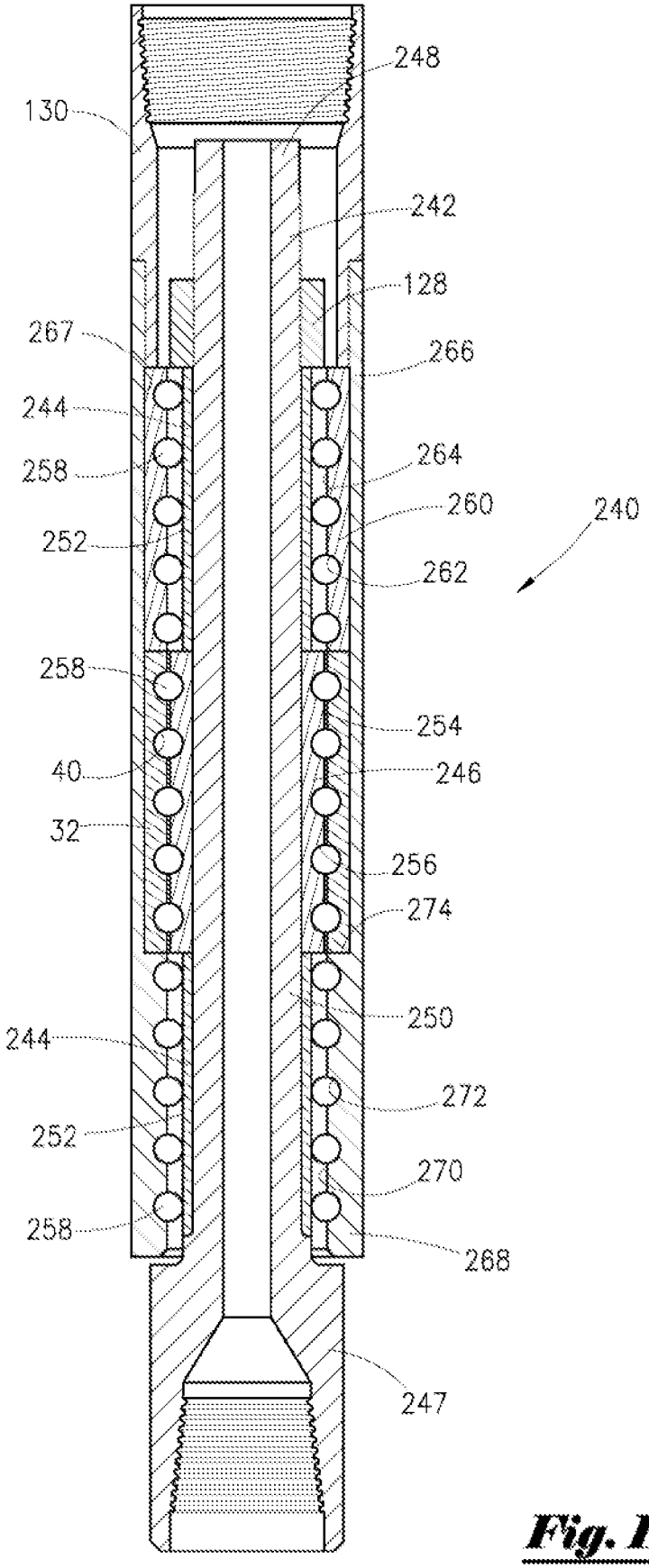
FIG. 11 is a cross-sectional view of an alternate embodiment of the integrated bearing section including a housing with grooves.

With reference to FIG. 11, integrated bearing section 240 is an alternate embodiment of the integrated bearing section of the present disclosure. Except as otherwise noted, integrated bearing section 240 includes the same features and functions in the same manner described above in connection with integrated bearing sections 160, with the same reference numerals indicating the same structure and function described above. Integrated bearing section 240 includes mandrel 242 and mandrel sleeves 244 and 246. Mandrel 242 may be formed of a generally cylindrical member including expanded diameter lower end 247 configured to engage and transmit torque to a drill bit. Each mandrel sleeve 244 and 246 may be formed of a cylindrical sleeve that slides over upper end 248 of mandrel 242 to be positioned around restricted diameter section 250 of mandrel 242. Mandrel sleeves 244 each includes flat profile outer surface 252. Outer surface 254 of mandrel sleeve 246 may include circumferential grooves 256 extending around the circumference of mandrel sleeve 246 and having a generally semi-circular profile as shown. Spherical members 258 may each be partially disposed within one of circumferential grooves 256. Outer radial bearing 260 and outer thrust bearing 32 may be disposed around mandrel sleeve 244 and mandrel sleeve 246, respectively. Outer radial bearing 260 may be formed of a cylindrical sleeve having circumferential grooves 262 extending around the circumference of inner surface 264. Spherical members 258 may be partially disposed within circumferential grooves 262 in outer radial bearing 260 and may engage flat profile outer surface 252 of mandrel sleeve 244. As mandrel 242 and mandrel sleeve 244 rotate together relative to outer radial bearing 260, each of these spherical members 258 may rotate within circumferential grooves 262 of outer radial bearing 260 and may freely travel in an axial direction along the flat profile outer surface 252 of mandrel sleeve 244. In this way, integrated bearing section 240 allows relative axial movement between mandrel 242 and outer radial bearing 260. Spherical members 258 are partially disposed within circumferential grooves 40 of outer thrust bearing 32 and partially disposed within circumferential grooves 256 of mandrel sleeve 246.

Integrated bearing section 240 also includes housing 266 with housing inner bore 267. A portion of mandrel 242, mandrel sleeves 244, 246, outer radial bearing 260, and outer thrust bearing 32 are disposed within housing inner bore 267. Housing 266 includes lower section 268 having inner surface 270 with circumferential grooves 272. Lower section 268 is disposed around one of the mandrel sleeves 244. Spherical members 258 are partially disposed within circumferential grooves 272 of housing 266 and engage flat profile outer surface 252 of mandrel sleeve 244. As mandrel 242 and mandrel sleeve 244 rotate together relative to housing 266, each of these spherical members 258 may rotate within circumferential grooves 272 of housing 266 and may freely travel in an axial direction along the flat profile outer surface 252 of mandrel sleeve 244. In this way, integrated bearing section 240 allows relative axial movement between mandrel 242 and housing 266. Housing 266 may include shoulder 274 above lower section 268. Shoulder 274 may retain outer thrust bearing 32 and outer radial bearing 260 within housing inner bore 267. For example, a lower end of outer thrust bearing 32 may engage shoulder 274, and a lower end of outer radial bearing 260 may engage an upper end of outer thrust bearing 32.

The assembly of integrated bearing section 240 may first involve the assembly of two cartridge units. One cartridge unit may be assembly by positioning spherical members 258 in circumferential grooves 262 of outer radial bearing 260 and sliding mandrel sleeve 244 through the central opening of outer radial bearing 260 to secure spherical members 258 in circumferential grooves 262 of outer radial bearing 260. The second cartridge unit may be assembled by positioning spherical members 258 in circumferential grooves 256 of mandrel sleeve 246 and securing the two sections of outer thrust bearing 32 (or "half shells") around mandrel sleeve 246 to secure spherical members 258 in circumferential grooves 256 of mandrel sleeve 246 and in circumferential grooves 40 of outer thrust bearing 32. Both cartridge units may be stored in the assembled state. A user may slide another mandrel sleeve 244 over upper end 248 of mandrel 242, position spherical members 258 within circumferential grooves 272 in lower section 268 of housing 266, and slide housing 266 over mandrel 242 and this mandrel sleeve 244 to secure spherical members 258 between lower section 268 of housing 266 and mandrel sleeve 244. A user may then slide the second cartridge unit and the first cartridge unit around upper end 242 of mandrel 242 and into housing inner bore 267. Nut member 128 may then be threadedly secured to upper end 248 of mandrel 242 to secure mandrel sleeves 244 and 246 around restricted diameter section 250 of mandrel 242. Finally, adapter 130 may be threadedly secured to upper end of housing 266. In this way, outer radial bearing 260 and outer thrust bearing 32 are secured within housing inner bore 267 between shoulder 274 and adapter 130.

In certain conventional bearing sections, smaller ball bearings are used in radial bearings and larger ball bearings are used in thrust bearings for a single bearing section. In the process of assembling these conventional bearing sections, operators or users sometimes mix up the ball bearings used for each. In each embodiment of the integrated bearing section disclosed herein, spherical members having the same size or radius may be used in the radial bearing portion and the thrust bearing portion. This design reduces assembly mistakes.

Each assembly described in this disclosure may include any combination of the described components, features, and/or functions of each of the individual assembly embodiments. Each method described in this disclosure may include any combination of the described steps in any order, including the absence of certain described steps and combinations of steps used in separate embodiments. Any range of numeric values disclosed herein includes any subrange therein. Plurality means two or more.

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. An integrated bearing section for a mud lubricated drilling motor, comprising:

a housing with a housing inner bore;

a mandrel at least partially disposed within the housing inner bore, the mandrel being a generally cylindrical unitary member having an inner bore for the transmission of a drilling mud and an expanded diameter lower end, the mandrel including an outer surface having a series of circumferential grooves;

a plurality of spherical members, wherein each of the spherical members is disposed partially within one of the circumferential grooves of the mandrel;

an outer radial bearing disposed around the mandrel and within the housing inner bore, the outer radial bearing including an even inner surface, wherein at least one of the spherical members engages the even inner surface of the outer radial bearing for allowing relative axial movement between the mandrel and the outer radial bearing; and an outer thrust bearing disposed around the mandrel and within the housing inner bore, the outer thrust bearing including an inner surface having a circumferential groove, wherein at least one of the spherical members engages the circumferential groove of the outer thrust bearing;

wherein the outer radial bearing and outer thrust bearing are in direct contact with each other.

2. The integrated bearing section of claim 1, wherein the inner surface of the outer radial bearing includes a shoulder configured to limit relative axial movement between the outer radial bearing and the mandrel.

3. The integrated bearing section of claim 1, wherein the outer thrust bearing is formed of two semi-cylindrical members.

4. The integrated bearing section of claim 1, wherein the outer thrust bearing is formed of a series of rings.

5. The integrated bearing section of claim 1, further comprising a second outer radial bearing disposed around the mandrel and within the housing inner bore, the second outer radial bearing including an even inner surface, wherein at least one of the spherical members engages the even inner surface of the second outer radial bearing for allowing relative axial movement between the mandrel and the second outer radial bearing, and wherein the outer thrust bearing is disposed between the outer radial bearing and the second outer radial bearing and wherein the second outer radial bearing and the outer thrust bearing are in direct contact with each other.

6. The integrated bearing section of claim 5, further comprising a nut member disposed around the mandrel and threadedly engaging an end of the housing, wherein the nut member includes an even inner surface, and wherein at least one of the spherical members engages the even inner surface of the nut member for allowing relative axial movement between the mandrel and the nut member.

7. The integrated bearing section of claim 1, wherein all spherical members have the same radius.

8. A method of absorbing a radial load and a thrust load in a mud lubricated drilling motor, comprising the steps of:

a) providing an integrated bearing section for the drilling motor comprising: a housing with a housing inner bore; a mandrel at least partially disposed within the housing inner bore, the mandrel being a generally cylindrical unitary member having an inner bore for the transmission of a drilling mud and an expanded diameter lower end, the mandrel including an outer surface having a series of circumferential grooves; a plurality of spherical members, wherein each of the spherical members is disposed partially within one of the circumferential grooves of the mandrel; an outer radial bearing disposed around the mandrel and within the housing inner bore, the outer radial bearing including an even inner surface, wherein at least one of the spherical members engages the even inner surface of the outer radial bearing for allowing relative axial movement between the mandrel and the outer radial bearing; and an outer thrust bearing disposed around the mandrel and within the housing inner bore, the outer thrust bearing including an inner surface having a circumferential groove, wherein at least one of the spherical members engages the circumferential groove of the outer thrust bearing; and wherein the outer radial bearing and outer thrust bearing are in direct contact with each other;

b) transmitting torque to the mandrel to rotate the mandrel relative to the housing, the outer radial bearing, and the outer thrust bearing;

c) absorbing a radial load with the outer radial bearing and absorbing a thrust load with the outer thrust bearing; and d) allowing relative axial movement between the outer radial bearing and the mandrel as the spherical members or the circumferential grooves wear.

9. The method of claim 8, further comprising the steps of:

e) disassembling the integrated bearing section;

f) increasing a radius of an axial cross section of each of the series of circumferential grooves in the mandrel and increasing a radius of the circumferential groove in the outer thrust bearing; and g) assembling the integrated bearing section with a plurality of larger spherical members, wherein each of the larger spherical members is disposed partially within one of the circumferential grooves of the mandrel, wherein at least one of the larger spherical members engages the circumferential groove in the outer thrust bearing, wherein a size of the larger spherical members is approximately equal to or slightly less than the radius of the axial cross section of the series of circumferential grooves in the mandrel.

* * * * *